United States Patent [19]

Platt et al.

[11] 3,994,482

[45] Nov. 30, 1976

[54] SPRING EDGE FOR FURNITURE DECKS

[75] Inventors: John G. Platt, Carthage; Robert O. Isaacs, Joplin, both of Mo.

[73] Assignee: Flex-O-Lators, Inc., Carthage, Mo.

[22] Filed: Nov. 12, 1975

[21] Appl. No.: 630,942

[52] U.S. Cl. ..... 267/102; 5/247; 297/452

[51] Int. Cl.[2] ..... F16F 3/00

[58] Field of Search ..... 5/247, 255; 267/80, 267/102, 107; 297/452, 458, 459

[56] References Cited

UNITED STATES PATENTS

| | | | |
|---|---|---|---|
| 3,151,853 | 10/1964 | Richardson et al. | 267/107 X |
| 3,497,883 | 3/1970 | Arnold et al. | 297/452 X |
| 3,727,980 | 4/1973 | Tischler | 297/458 |
| 3,888,473 | 6/1975 | Mandusky et al. | 267/102 |

*Primary Examiner*—James C. Mitchell
*Attorney, Agent, or Firm*—John A. Hamilton

[57] ABSTRACT

A spring edge for a furniture deck, the deck consisting of a wire fabric deck sheet resiliently supported over a rigid frame, the spring edge consisting of a series of generally V-shaped sinuous spring elements distributed along the forward edge of the frame, opening forwardly, the lower legs of the elements being fixedly related at their forward ends to the frame and deck, and the apices of the elements being connected to the deck for forward and rearward sliding movement, the upper legs of the spring elements being inclined upwardly and forwardly and supporting a transversely extending horizontal border wire at their upper ends.

3 Claims, 5 Drawing Figures

Figure 1:
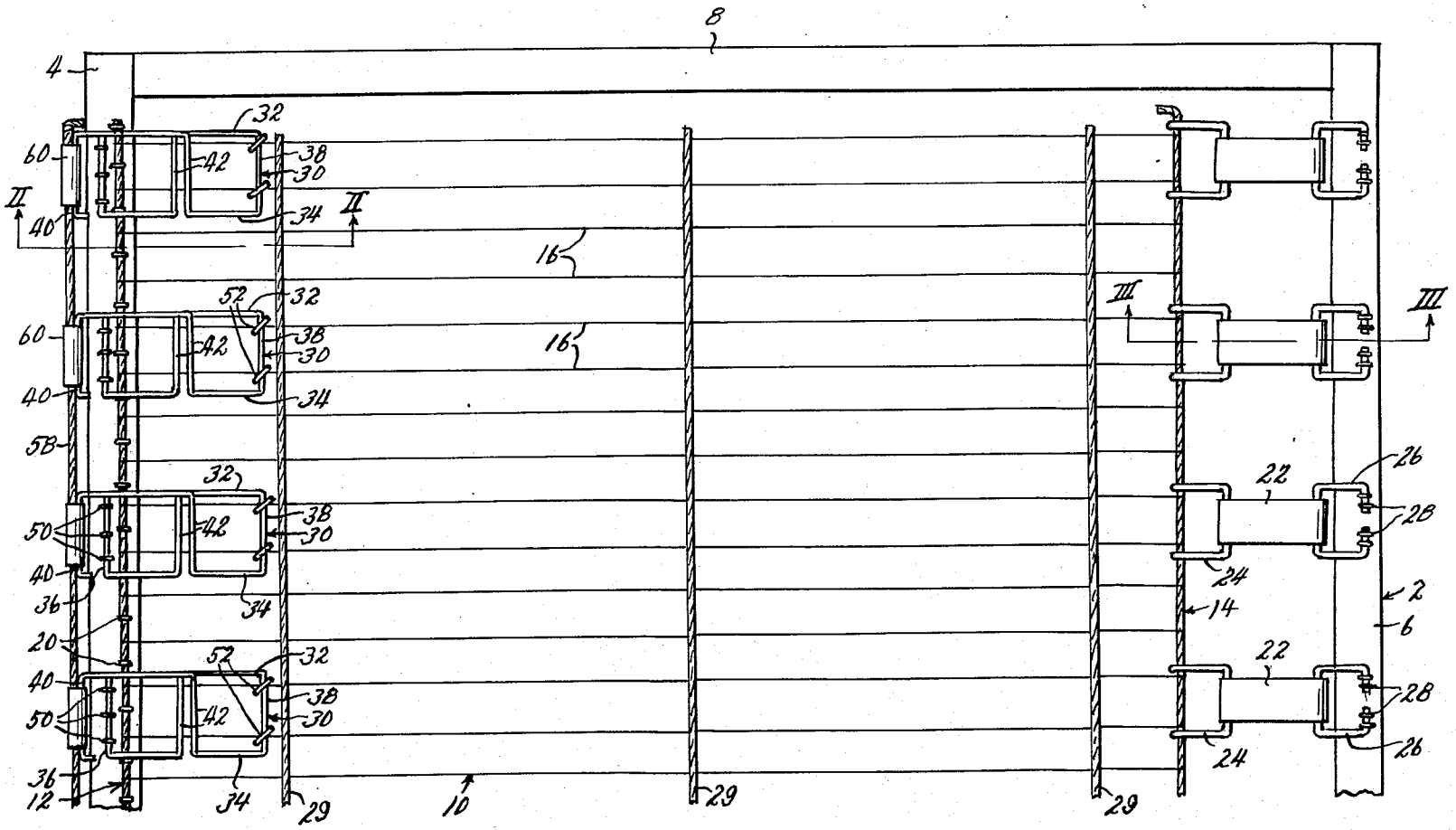

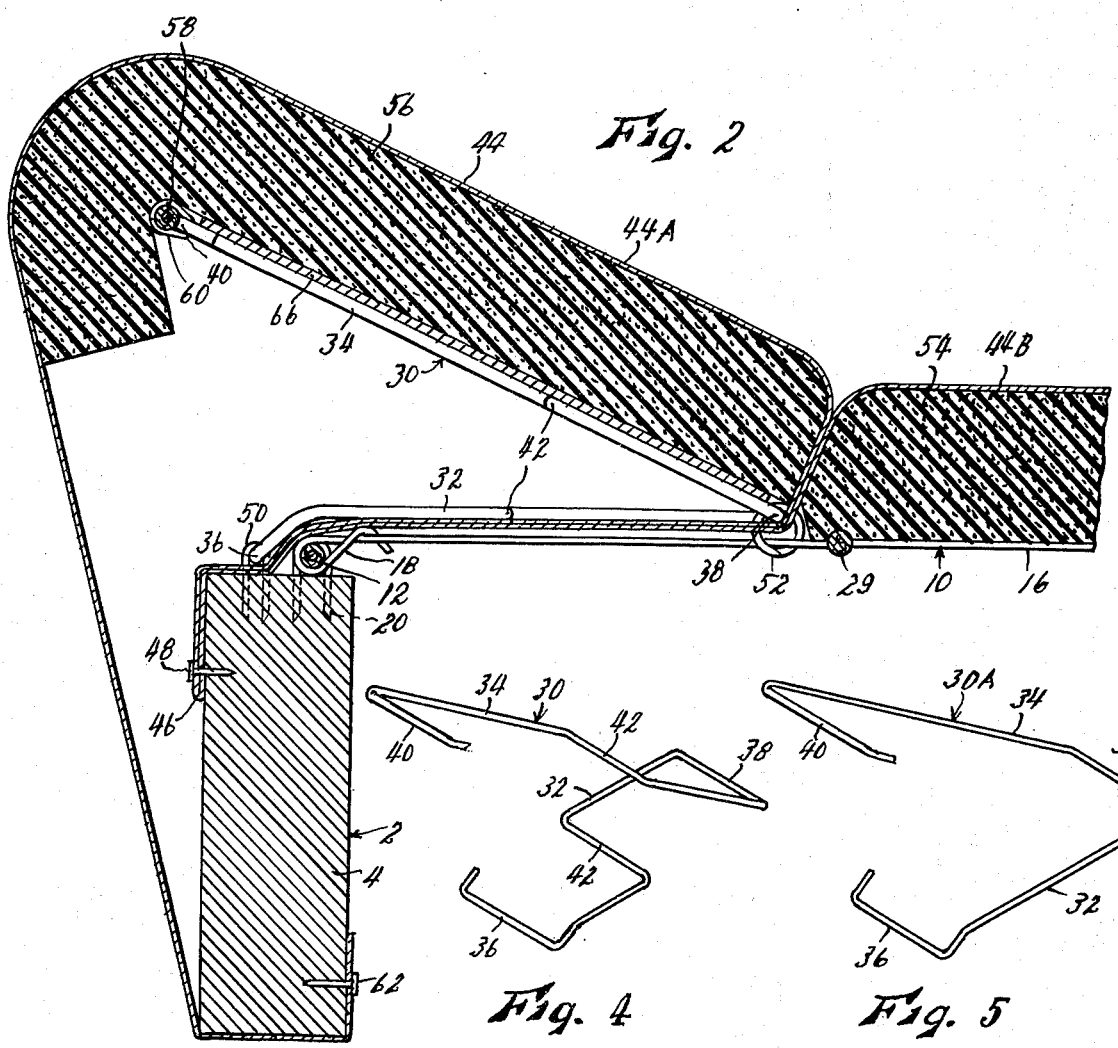
Fig. 2
Fig. 4
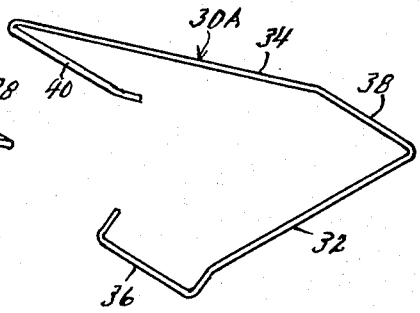
Fig. 5
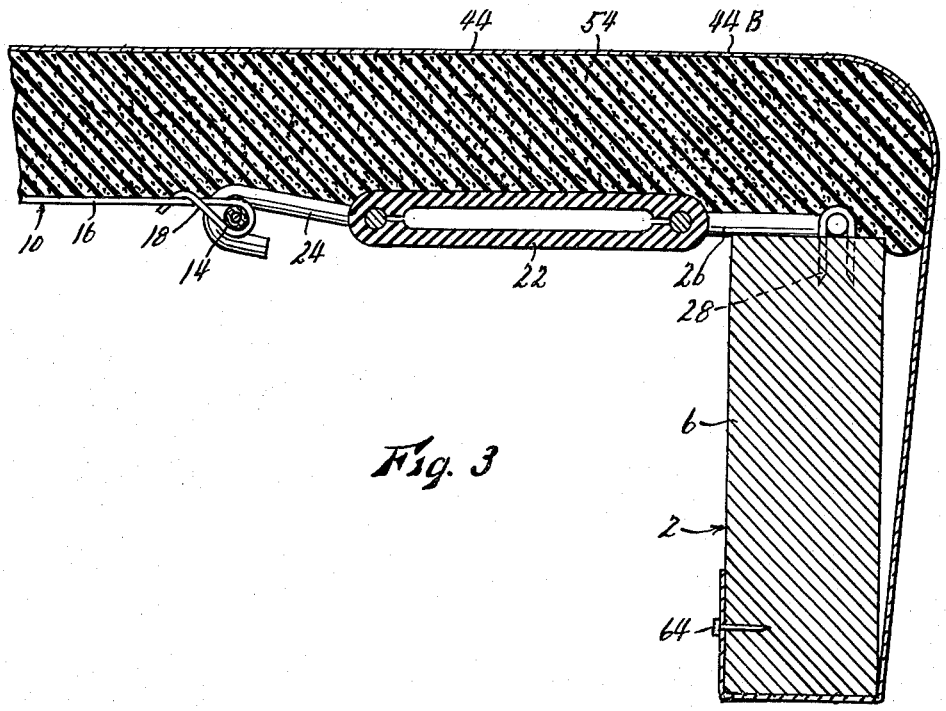
Fig. 3

SPRING EDGE FOR FURNITURE DECKS

This invention relates to new and useful improvements in spring edges for upholstered furniture.

In upholstered furniture such as sofas and couches wherein loose seat cushions are simply laid on and are supported by a resilient substructure or "deck", it is customary to provide a raised edge along the forward edge of the deck. This "edge" has the functions both of preventing the cushions from sliding forwardly on the deck, and also of closing and concealing the vertical gap or open space which would otherwise appear between the deck and the lower front edge of the cushion, especially if the cushions have bulging or "crowned" upper and lower faces, as is usually the case. Also, the deck, while commonly resiliently yieldable, usually is mounted over a rigid frame, and has only thin padding, so that the forward deck edge, while padded, is usually very firm, creating a generally undesirable "hard edge" effect. Edging strips formed of lengths, of generally triangular cross-sectional contour, and made of plastic or rubber foam or the like, have heretofore been used, and do provide a padding over the forward frame edge, but are difficult to secure in place against the constantly repeated shifting loads to which they are subjected in normal usage, and also do not provide the distance or "depth" of yieldability required for a high degree of comfort.

The desirability of a greater yieldable depth suggests the use of some type of edging utilizing springs rather than just padding material, and spring edges have heretofore been proposed, but all such prior devices within our knowledge have been subject to certain disadvantages. They have tended to be rather complicated and hence disadvantageously expensive. They have also been rather difficult to assemble, such assembly often requiring skilled labor, which also represents added cost. They have generally included rather sharply angled spring wires, the angles representing points of stress concentration when flexed in usage, at which fatigue and cystallization of the wires occurs and causes premature breakage and failure thereof. They have been difficult to secure permanently in proper relation to the frame and deck elements, and when secured to the deck springs in spaced relation from the frame, have often interfered with and changed the normal action of the deck springs.

Accordingly, the object of the present invention is the provision of a spring-type deck edging which overcomes all of the above enumerated disadvantages and shortcomings of prior devices, in that it is quite simple and hence relatively economical, is easily installed by unskilled labor, in which the spring elements are so formed that most of the stress of the spring wires is distributed as torsional strain along substantial lengths of the wires, rather than being concentrated at sharp bends of the wires, and in that it has only sliding engagement with the deck wires, so that there is substantially no interaction between the deck and edge springs, while at the same time the edge springs are securely anchored relative to the deck. Generally, these objects are accomplished, in connection with a furniture deck consisting of a wire fabric resiliently supported over a rigid frame, of a spring edge consisting of a series of V-shaped or "fishmouth" spring elements distributed across the forward edge of the deck, and opening forwardly, each element having a lower leg affixed at its forward end to the frame, and an upwardly and forwardly inclined upper leg carrying a border wire at its upper end. Each spring element is sinuous in form, having a transverse section at its apex, whereby it yields primarily in torsion rather than by bending. The apex of each element is secured to the deck wires rearwardly of the front edge of the frame, but is slidable forwardly and rearwardly relative to said wires, so that the element does not stiffen nor affect the yield characteristics of the deck.

Other objects are simplicity and economy of construction, and efficiency and dependability of operation.

With these objects in view, as well as other objects which will appear in the course of the specification, reference will be had to the accompanying drawing, wherein:

FIG. 1 is a fragmentary top plan view of a furniture deck including a spring edge construction embodying the present invention, with the padding and cover layers omitted, FIG. 2 is an enlarged, fragmentary sectional view taken on line II—II of FIG. 1, including the padding and cover layers, FIG. 3 is an enlarged, fragmentary sectional view taken on line III—III of FIG. 1, including the padding and cover layers, FIG. 4 is a perspective view of one of the edge spring elements, and FIG. 5 is a perspective view of an alternative form of the edge spring element.

Like reference numerals apply to similar parts throughout the several views, and the numeral 2 applies generally to the frame of a seat deck for upholstered furniture. Said frame, as shown, is of rigid rectangular form, including a front rail 4, rear rail 6, and side rails 8 (one shown). The frame may of course be of any desired width.

The deck platform, indicated generally by the numeral 10, consists of a front strand 12 and a rear strand 14 which are parallel and extend transversely of the seat, and a series of closely spaced apart, parallel cross strands 16 extending forwardly and rearwardly between said front and rear strands and securely fastened thereto. Each of the front and rear strands consists of a spring steel wire core, covered by a sheath of soft, indentable material, and the corresponding end portion of each cross strand 16, said cross strands constituting spring steel wires, is "knotted" about said sheath, as best shown at 18 in FIGS. 2 and 3. The sheath provides good purchase for the cross wires on the front and rear strands, and also prevents rubbing or grating "wire noises". Front strand 12 of the deck overlies the top edge of front frame rail 4, and is affixed thereto by staples 20 distributed along the length thereof. Rear strand 14 is spaced forwardly of and parallel to rear frame rail 6, and is connected thereto by resiliently extensible members 22, said members as shown each comprising a closed loop of rubber or the like, looped at its forward end around a wire bracket 24 hooked around rear strand 14, and looped at its rearward end around a wire bracket 26 secured to rear frame rail 6 by staples 28. The size, strength and spacing of loops 22 is so selected as to impart the desired degree of resilient yieldability to deck 10. However, the use of rubber loops 22 as connectors is exemplary only. Helical steel springs or the like could be used in place of said loops. Cross wires 16 may be connected together at spaced points along their length by intermediate strands 29 extending parallel to front and rear strands 12 and 14. The intermediate strands may consist of twisted paper ropes, pierced by each of cross wires 16 at its point of intersection therewith.

The spring edge forming the subject matter of the present invention is disposed along the forward edge of frame 2, and consists primarily of a series of spring elements each designated generally by the numeral 30, spaced along said forward frame edge. Each of said spring elements is formed of a single length of spring steel wire, and considered in a vertical plane is of V-form, having a generally horizontal lower leg 32, and an upwardly and forwardly inclined upper leg 34. Considered horizontally, each of legs 32 and 34 is of sinuous form, as best shown in FIG. 4. In this case, the sinuous turns of each leg are generally square, as shown, but this is a matter of choice, and the turns could be rounded if desired. The number of sinuous turns in each leg is immaterial, the essential requirement being that each spring element include a horizontal transverse reach 36 at the forward end of its lower leg 32, a horizontal transverse reach 38 at its apex, and a horizontal transverse reach 40 at the forward end of its upper leg 34. Additional horizontal transverse reaches may be provided intermediate the ends of each spring leg, as shown at 42 in FIG. 4, or omitted as shown in the alternative form of the spring element illustrated in FIG. 5. The FIG. 4 form provides a somewhat better and more durable spring action than the FIG. 5 form, and also provides better support for the overlying padding layer, as will appear, but the FIG. 5 form is fully illustrative of the basic features of the invention.

After deck 10 is applied to frame 2 as shown, a cover layer 44 formed of material of natural or synthetic fabric or the like, and of a size capable of covering the entire top and vertical side edges of the seat, is folded along a line transverse to the seat, as indicated at 46, in FIG. 2, and tacked to the front face of front frame rail 4 adjacent said fold, as indicated at 48. Both of the cover layers 44A and 44B formed by fold 46 are then laid rearwardly over the top of deck 10. Reaches 36 of spring elements 30 are then secured to the top edge of front frame rail 4 by staples 50 forwardly of front strand 12 of deck 10, said staples piercing both layers of cover 44 as shown in FIG. 2. Apex reaches 38 of the spring elements are then secured to cross wires 16 of the deck, in rearwardly spaced relation from front rail 4, by wire clips 52 commonly known as "hog rings", said hog rings also piercing both layers of cover 44 as shown. A border wire 58, which may be a paper-sheathed spring steel wire in the same manner as deck strands 12 and 14, is then extended the full width of the seat at the upper ends of spring legs 34, and firmly secured to reaches 40 of said spring legs by sheet metal clips 60. A layer 54 of padding material such as natural or synthetic foam or cotton felt is then laid over deck 10 rearwardly of spring elements 30, and a similar layer 56 of pading material is laid over the top surfaces of upper legs 34 of spring elements 30. Both layers of cover 44 are led upwardly between the contiguous edges of padding layers 54 and 56. Finally, cover layer 44A is pulled forwardly over padding 56 then downwardly in front of and under the lower edge of front frame rail 4, and tacked to the inner surface of said rail as at 62, while cover layer 44B is pulled rearwardly over padding 54, then downwardly behind and under the lower edge of rear frame rail 6, and tacked to the forward surface of said rail as at 64. Upper legs 34 of the spring elements may not provide sufficiently continuous support for padding 56, particularly if the spring elements are widely spaced apart, or if the spring element as shown in FIG. 5 is used, and might therefore allow sagging of the padding intermediate the spring elements. To prevent this, a layer 66 of stiff but flexible cardboard or the like may be interposed between padding 56 and spring legs 34, as shown in FIG. 2. Cover layer 44 A may be pulled to any desired degree of tension before it is tacked at 62, thereby acting as a "tie-down" element providing any desired degree of pretensioning of the spring elements, and hence any desired degree of relative firmness or yieldability of the raised deck edge formed by said spring elements.

It will thus be apparent that a deck edge assembly having several advantages has been provided. It is spring-supported, not merely padded, and hence provides a depth of yieldability producing a high degree of comfort. It is rigidly secured to the deck frame by staples 50, and hence cannot be displaced or misaligned in normal usage. It is simple and economical, both in original manufacturing and in installation, installation by unskilled labor being entirely practical. The horizontal transverse spring reaches provided by the sinuous form of the spring elements, particularly at the apices of their V-form, provide that the spring yields to a large extent in torsion distributed along relatively long portions of the spring wires, rather than concentrating the stresses at sharp bends of the wires. Thus the wires are less likely to fail or break under the stresses of long periods of hard usage. Since the spring elements are connected to deck wires 16 only loosely by hog rings 52, and since wires 16 extend parallel to the V-plane of the spring elements, a sliding movement of the spring element apeces 38 along wires 16 will occur when the deck is flexed downwardly in use. This provides a complete separation between the action of the resilient means supporting the deck and the action of spring elements 30, so that there can be no interference therebetween.

While we have shown and described a specific embodiment of our invention, it will be readily apparent that many minor changes of structure and operation could be made without departing from the spirit of the invention.

What we claim as new and desire to protect by Letters Patent is:

1. In combination with a furniture seat including a rigid frame and a wire fabric deck sheet extending over said frame and being resiliently supported thereby for downward yieldability, a spring edge assembly extending across the forward edge of said seat and comprising:

a. a series of spring elements spaced across the forward edge of said frame, each of said elements being substantially V-shaped in a vertical plane, opening forwardly, and having a generally horizontal lower leg and an upwardly and forwardly inclined upper leg, said spring element constituting a length of spring wire sinuous in a plane at right angles to its vertical V-plane whereby to present horizontal reaches transverse to said plane at least at the apex and at the free ends of the legs of said spring element, b. means securing the horizontal transverse reaches at the free ends of said lower legs to said frame, and c. means securing the horizontal transverse reaches at the apices of said spring elements to said deck sheet rearwardly of the forward edge of said deck sheet, said last named securing means being operable to permit relative forward and rearward sliding movement between said deck sheet and said spring elements.

2. The structure as recited in claim 1 wherein said transverse reach at the apex of each of said spring elements is connected to said deck sheet at at least two points spaced apart longitudinally along the length of said reach, whereby said reach is maintained generally in the plane of said deck sheet.

3. The structure as recited in claim 2 wherein said deck sheet includes a series of parallel, spaced apart spring wires extending forwardly and rearwardly beneath said spring elements, the transverse wire reach at the apex of each of said spring elements bridging and intersecting at least two of said deck wires, and wherein the means securing said reach to said deck sheet comprises a looped wire clip loosely encircling said spring element reach and each deck wire intersected thereby.

* * * * *